US009867758B2

(12) United States Patent
Bushara

(10) Patent No.: US 9,867,758 B2
(45) Date of Patent: Jan. 16, 2018

(54) DEVICE AND METHOD FOR GAIT SYNCHRONIZED SENSORY STIMULATION OF THE LOWER EXTREMITIES

(71) Applicant: Regents of the University of Minnesota, Minneapolis, MN (US)

(72) Inventor: Khalafalla Bushara, Eden Prairie, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 399 days.

(21) Appl. No.: 14/602,046

(22) Filed: Jan. 21, 2015

(65) Prior Publication Data

US 2015/0209216 A1 Jul. 30, 2015

Related U.S. Application Data

(60) Provisional application No. 61/931,952, filed on Jan. 27, 2014.

(51) Int. Cl.
*A61H 11/00* (2006.01)
*A61H 9/00* (2006.01)
*A61H 7/00* (2006.01)

(52) U.S. Cl.
CPC ..... *A61H 9/0085* (2013.01); *A61H 7/001* (2013.01); *A61H 7/007* (2013.01);
(Continued)

(58) Field of Classification Search
CPC ..... A61H 9/0085; A61H 7/001; A61H 7/007; A61H 2205/125; A61H 2201/165;
(Continued)

(56) References Cited

U.S. PATENT DOCUMENTS 5,025,575 A * 6/1991 Lakic ..... A41D 19/001 36/29
5,711,760 A * 1/1998 Ibrahim ..... A61H 9/0078 601/149

(Continued)

FOREIGN PATENT DOCUMENTS

EP 2591693 A1 5/2013

*Primary Examiner* — Steven Douglas
(74) *Attorney, Agent, or Firm* — Schwegman Lundberg & Woessner, P.A.

(57) ABSTRACT

A device can comprise: a trigger chamber, having a trigger elastic wall and a trigger base wall, the trigger chamber configured for relative motion between the trigger elastic wall and the trigger base wall; a connecting line fluidly coupled to the trigger chamber, the connecting line having a substantially inelastic wall; a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface; a plurality of projections coupled to the exterior surface; and a stabilizing frame, the stabilizing frame having a substantially rigid wall, the stabilizing frame having a plurality of apertures, the stabilizing frame extending over the stimulation chamber, the projections configured to extend through the apertures when the stimulation chamber is expanded.

19 Claims, 6 Drawing Sheets

(52) U.S. Cl.
CPC ..... *A61H 2201/1284* (2013.01); *A61H 2201/164* (2013.01); *A61H 2201/165* (2013.01); *A61H 2205/102* (2013.01); *A61H 2205/12* (2013.01); *A61H 2205/125* (2013.01)

(58) Field of Classification Search
CPC ..... A61H 2205/102; A61H 2205/12; A61H 2201/1284; A61H 2201/164; A61H 2201/5002; A61H 2201/5058; A61H 2201/5069; A61H 2201/2071; A61H 2201/5084; A61H 2205/106; A61H 2209/00
See application file for complete search history.

(56) References Cited

U.S. PATENT DOCUMENTS

| | | | | |
|---|---|---|---|---|
| 6,387,064 | B1 * | 5/2002 | Gunnon | A43B 7/00 601/148 |
| 2006/0189905 | A1 * | 8/2006 | Eischen, Sr. | A43B 23/029 601/152 |
| 2007/0203435 | A1 | 8/2007 | Novak | |
| 2012/0167414 | A1 | 7/2012 | Shrairman | |
| 2013/0118029 | A1 | 5/2013 | Kim | |
| 2013/0310719 | A1 * | 11/2013 | Davis | A61H 9/0085 601/149 |
| 2015/0351996 | A1 * | 12/2015 | Bukharina | A61H 7/001 601/134 |

* cited by examiner

DEVICE AND METHOD FOR GAIT SYNCHRONIZED SENSORY STIMULATION OF THE LOWER EXTREMITIES

CLAIM OF PRIORITY

This application claims the benefit of U.S. Provisional Patent Application Ser. No. 61/931,952, filed on Jan. 27, 2014, and which is incorporated by reference herein in its entirety.

BACKGROUND

Impaired gait and balance is a disabling feature in many neurological and geriatric conditions that can lead to risk of falling and injury. Studies have shown improvement of gait and balance using somatosensory stimulation (vibratory, tactile, pressure/proprioceptive) of the feet. It is believed that such improvement in function is related to additional sensory feedback provided by stimulating the feet. In Parkinson's disease, sensory stimulation can improve gait and "unlock" freezing of movement. For example, patients with Parkinson's disease can ride a bicycle with relative ease; a phenomenon that is attributed to intermittent sensory feedback provided by the movement of cycling.

OVERVIEW

A device for gait synchronized sensory stimulation of the lower extremities can provide mechanical stimulation to one or more parts of the foot or body in phase with the step. Foot stimulation can be used to improve stance, balance and gait of both central and peripheral conditions that cause impaired gait and imbalance. Stimulation of the feet or other body areas can provide treatment for freezing gait, ataxic gait, vestibular dysfunction, pain, and other physical conditions. There is a need for a less cumbersome and less expensive gait stimulation device that can operate without vibrators, electric apparatus, or batteries requiring periodic replacement and maintenance. There is also a need for a stimulation device that can have a flexible location of both triggering portions and stimulating portions. Described herein is a device and method for gait synchronized sensory stimulation of the lower extremities that is a closed fluid system. The closed fluid system can be filled with air, a gas, a liquid, a gel, or a combination thereof. The fluid system can include a triggering chamber, a stimulation chamber, a connecting line, and a plurality of stimulation projections. The device and method can be used to stimulate any part of the foot or other parts of the body. The stimulation can be triggered by any part of the foot that causes pressure on the inside of an article of footwear during stance and ambulation.

Portions of the triggering chamber and stimulation chamber can be formed of an elastic material. Pressure can compress elastic portions of the triggering chamber and force fluid from the triggering chamber through a connecting line and into a stimulation chamber. Elastic portions of the stimulation chamber expand. Projections on the outer surface of the stimulation chamber can contact a portion of the user's body and provide stimulation. Placement of the triggering chamber and/or stimulation chamber can depend on what disease or condition is being treated. The device can also be used to provide stimulation in phase with a gait for training, sports, or educational activities. Multiple triggering chambers can be used in the same article of footwear. Multiple stimulation chambers can be connected to one triggering chamber.

This overview is intended to provide an overview of subject matter of the present patent application. It is not intended to provide an exclusive or exhaustive explanation of the invention. The detailed description is included to provide further information about the present patent application.

To further illustrate the and device and method disclosed herein, a non-limiting list of examples is provided here:

In Example 1, a device can comprise: a trigger chamber, having a trigger elastic wall and a trigger base wall, the trigger chamber configured for relative motion between the trigger elastic wall and the trigger base wall; a connecting line fluidly coupled to the trigger chamber, the connecting line having a substantially inelastic wall; a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface; a plurality of projections coupled to the exterior surface; and a stabilizing frame, the stabilizing frame having a substantially rigid wall, the stabilizing frame having a plurality of apertures, the stabilizing frame extending over the stimulation chamber, the projections configured to extend through the apertures when the stimulation chamber is in an expanded state.

In Example 2, the device of Example 1 can optionally be configured such that when the stimulation chamber is in the expanded state, a tip of each projection extends outwardly from an outer surface of the stabilizing frame a distance in the range of 2-15 mm.

In Example 3, the device of any one or any combination of Examples 1-2 can optionally be configured such that when the stimulation chamber is in a retracted state, a tip of each projection extends outwardly from an outer surface of the stabilizing frame a distance in the range of 0-2 mm.

In Example 4, the device of any one or any combination of Examples 1-3 can optionally be configured such that a tip of each projection extends outwardly from the exterior surface a distance in the range of 2-20 mm.

In Example 5, the device of any one or any combination of Examples 1-4 can optionally be configured such that the stimulation elastic wall is configured of at least one of natural rubber, silicone rubber, ethylene propylene rubber, and thermoplastic rubber.

In Example 6, the device of any one or any combination of Examples 1-5 can optionally be configured such that the trigger elastic wall is configured of at least one of natural rubber, silicone rubber, ethylene propylene rubber, and thermoplastic rubber.

In Example 7, the device of any one or any combination of Examples 1-6 can optionally be configured such that the trigger elastic wall has a thickness in the range of 0.2-30 mm and the stimulation elastic wall has a thickness in the range of 0.2-30 mm and the stimulation elastic wall is thinner than the trigger elastic wall.

In Example 8, the device of any one or any combination of Examples 1-7 can optionally be configured such that the stimulation base wall and the trigger base wall have a flat profile and are configured of a rigid plastic material.

In Example 9, the device of any one or any combination of Examples 1-8 can optionally be configured such that the connecting line has a flattened cross-sectional profile having a height distance in the range of 6-16 mm.

In Example 10, the device of any one or any combination of Examples 1-9 can optionally be configured to further include a second connecting line fluidly coupled to the trigger chamber and the second connecting line fluidly coupled to a second stimulation chamber.

In Example 11, the device of Example 10 can optionally be configured to further include a third connecting line fluidly coupled to the trigger chamber and the third connecting line fluidly coupled to a third stimulation chamber.

In Example 12, the device of any one or any combination of Examples 1-11 can optionally be configured such that each of the plurality of projections is configured to be integral with the exterior surface, and each of the plurality of projections includes at least one of a narrowed tip and a rigid material.

In Example 13, the device of any one or any combination of Examples 1-12 can optionally be configured such that the device is configured to be removable from an article of footwear and usable in a different article of footwear.

In Example 14, the device of any one or any combination of Examples 1-13 can optionally be configured such that the trigger chamber, the connecting line, and the stimulation chamber are a closed fluid system.

In Example 15 a device can comprise: a trigger chamber, having a trigger elastic wall and a trigger base wall, the trigger chamber configured for relative motion between the trigger elastic wall and the trigger base wall, wherein the trigger chamber is configured to be located in one of a heel area, a toe area, and a side area of an article of footwear; a connecting line fluidly coupled to the trigger chamber, the connecting line having a substantially inelastic wall; a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface, wherein the stimulation chamber is configured to be located in at least one of an ankle area, an upper toe area, a foot dorsum area, a leg area, and a side area of an article of footwear; a plurality of projections coupled to the exterior surface; and a stabilizing frame extending over the stimulation chamber.

In Example 16, a method can comprise: compressing a trigger chamber, the trigger chamber having a trigger elastic wall and a trigger base wall, the trigger chamber configured for relative motion between the trigger elastic wall and the trigger base wall; forcing fluid through a connecting line, the connecting line fluidly coupled to the trigger chamber, the connecting line having a substantially inelastic wall; expanding a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface, wherein expanding the stimulation chamber causes a plurality of projections to contact a user, the plurality of projections coupled to the exterior surface; and extending a projection through an aperture in a stabilizing frame, the stabilizing frame covering the stimulation chamber, the stabilizing frame having a substantially rigid wall.

In Example 17, the method of Example 16 can optionally be configured to further include retracting the stimulation chamber, wherein a tip of each of the plurality of projections is configured to be located below the exterior surface of the stabilizing frame.

In Example 18, the method of any one or any combination of Examples 16-17 can optionally be configured such that the compressing of the trigger chamber and expanding the stimulating chamber are in phase with a gait.

In Example 19, the method of any one or any combination of Examples 16-18 can optionally be configured to further include forcing fluid through a second connecting line, the second connecting line fluidly coupled to the trigger chamber, the second connecting line having a substantially inelastic wall; and expanding a second stimulation chamber fluidly coupled to the second connecting line.

In Example 20, the method of Example 19 can optionally be configured to further include forcing fluid through a third connecting line, the third connecting line fluidly coupled to the trigger chamber, the third connecting line having a substantially inelastic wall; and expanding a third stimulation chamber fluidly coupled to the third connecting line.

In Example 21, the device and method of any one or any combination of Examples 1-20 can optionally be configured such that all elements, operations, or other options recited are available to use or select from.

These and other examples and features of the present injection instrument and method will be set forth in part in the following Detailed Description. This Overview is intended to provide non-limiting examples of the present subject matter—it is not intended to provide an exclusive or exhaustive explanation. The Detailed Description below is included to provide further information about the present injection instrument and method.

BRIEF DESCRIPTION OF THE DRAWINGS

In the drawings, which are not necessarily drawn to scale, like numerals may describe similar components in different views. Like numerals having different letter suffixes may represent different instances of similar components.

Figure 1:
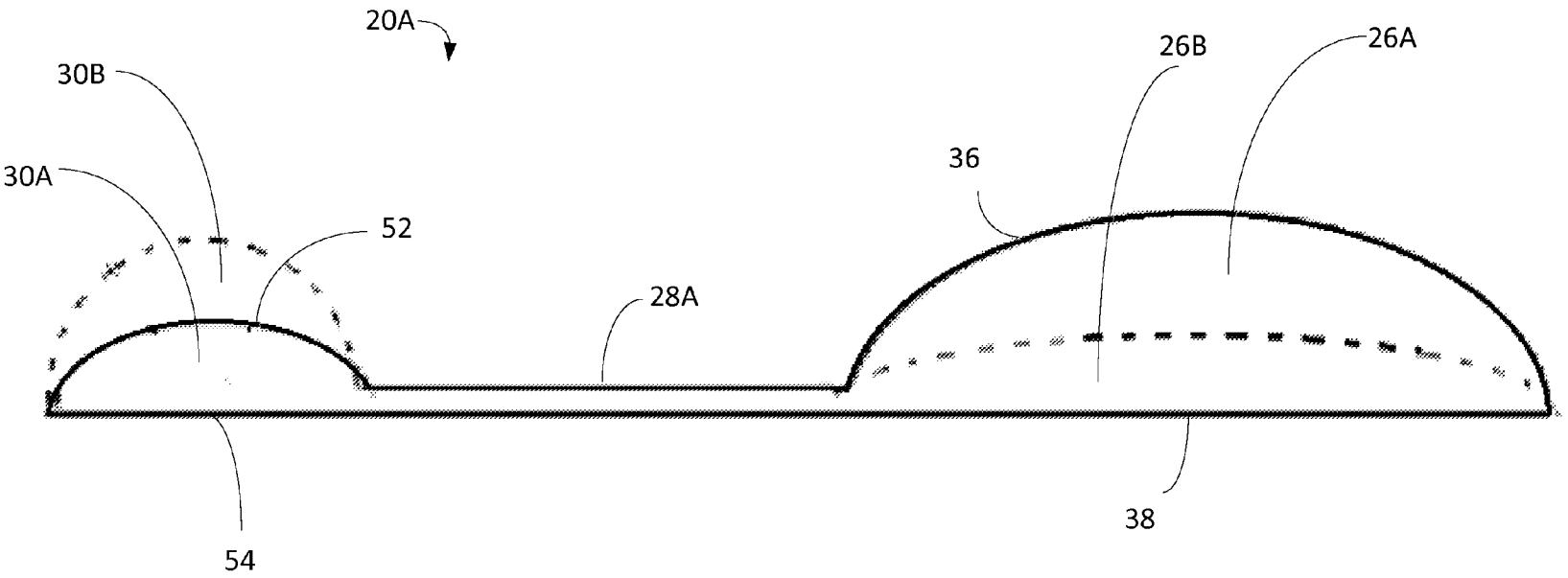
FIG. 1 illustrates a schematic view of a device, in accordance with at least one example of the present subject matter.

The drawings illustrate generally, by way of example, but not by way of limitation, various embodiments discussed in the present document.

DETAILED DESCRIPTION

Foot stimulation can be used to improve, stance, balance and gait of both central and peripheral conditions that can cause impaired gait and imbalance. Conditions that can specifically benefit from the device and method disclosed herein can include freezing gait such as from Parkinson's disease or normal pressure hydrocephalus, ataxic gait, peripheral neuropathy, and general imbalance in the elderly. Additional neurological conditions that can cause freezing gait, reduced sensory feedback, and central gait and stance deficits that may benefit from the device and method disclosed herein can also include disorders related to Parkinson's disease, ischemic white matter disease, multiple sclerosis, vasculitis, leukoencephalopathy, cerebellar ataxia, spinal cord diseases, peripheral neuropathy due diabetes, autoimmune diseases, amyloid disease, HIV-AIDS, vitamin deficiency, and vestibular dysfunction.

The device and method disclosed herein can also be used for pain relief. Stimulation of any body part can modulate pain through a gate control theory mechanism. Non-painful stimuli in or near the source of pain can modulate the brain response to pain. The device and method disclosed herein may relieve foot pain from any cause such as peripheral neuropathy, vascular insufficiency, arthritis, bony spurs, neuromata and orthopedic conditions. The device and method disclosed herein can provide stimulation of areas of a body that are far from the triggering site. This method can be used to relieve pain, for example, by stimulating near the knee while walking or stimulating the site of herpes neuralgia in the trunk/back skin while walking.

The device and method disclosed herein can be used as a source of training signals. In an example, an undesired movement can trigger stimulation and provide feedback while dancing or playing certain sports. Tactile stimulation of the foot for short periods may improve stance and gait balance thereafter.

The device and method disclosed herein can also provide a versatile method that allows for foot stimulation to address specific and unique neurological phenomena. For example in freezing of gait in Parkinson's disease significant pressure can be exerted by the patient at the forefoot area often several times in an attempt to start a step. If such pressure is used to trigger foot stimulation, the stimulation can occur in time to unlock the gait freeze. Similarly, foot stimulation can be triggered by swaying causing pressure at the medial or lateral edges of the foot, thus providing feedback when needed before further imbalance occurs. The device and method disclosed herein can provide stimulation to virtually any part of the foot such as the foot dorsum (top of the foot), the toes, the ankle area, and other lower extremity regions that are not necessarily close to a triggering site.

The stimulation site can be selected for specific neurological conditions resulting in a specific gait problem. For example, freezing in Parkinson's disease is characteristically associated with repeated high pressure from the forefoot when stimulation is needed. The device and method disclosed herein can be used to aid a freezing problem in Parkinson's disease by providing stimulation to single or multiple areas of the foot when needed to unlock the gait freeze. Another example is peripheral neuropathy where the desired stimulation site is higher (more proximal) than the sole of the foot. Peripheral neuropathy is typically length-dependent with the distal areas are much less sensitive than proximal areas. In other words, the sole is the least sensitive part of the lower extremities in peripheral neuropathy and therefore its stimulation may be ineffective in providing sensory feedback. The device and method disclosed herein can provide the use of multiple trigger points that may be needed in certain neurological conditions to improve gait. For example in cerebellar ataxia, swaying and steps are irregular in time and space thus causing high pressure in various areas of the foot at irregular time intervals. The device and method disclosed herein can provide sensory stimulation as needed during the ataxic gait.

FIG. 1 illustrates a schematic view of a device 20A, in accordance with at least one example of the present subject matter. The device 20A can be a closed fluid system, having a connected inner area filled with a fluid such as air, a gas, a liquid, a gel or combinations thereof. The device 20A can include a trigger chamber 26A, a connecting line 28A, and a stimulation chamber 30A. A first end of the connecting line 28A can be fluidly coupled to the trigger chamber 26A. A second end of the connecting line 28A can be fluidly coupled to the stimulation chamber 30A. The trigger chamber 26A can include a trigger elastic wall 36 and a trigger base wall 38. The trigger elastic wall 36 and a trigger base wall 38 can be configured for relative movement between them.

In an example, the trigger elastic wall 36 can be an elastomeric material, a rubber-like material, natural rubber, a silicone rubber, an ethylene propylene rubber, or a thermoplastic rubber. In an example, the trigger elastic wall 36 and the trigger base wall 38 can be two separate pieces coupled together. The trigger base wall 38 can include a flat profile and can be formed of a rigid material such as plastic. There can be a fluid tight seal between the trigger elastic wall 36 and the trigger base wall 38, having an opening to the connection line 28A. The trigger base wall 38 can be placed against a surface, such as the bottom of an article of footwear. The thickness of the trigger elastic wall 36 can be in the range of 0.2-30 mm. The trigger elastic wall 36 can include inner ridges that can aid in maintaining a dome shape.

The connecting line 28A can be a substantially inelastic material, such as a rigid polymer, metal, plastic, or combinations thereof. The connecting line 28A can include a circular or flattened profile, such as a rectangular or oval cross section, having a height in the range of 2-20 mm. The connecting line 28A can have a length from the first end to a second end in the range of 20 mm-2000 mm. The flattened profile of the connecting line 28A can provide a space saving profile when placed in an article of footwear.

The stimulation chamber 30A can include a stimulation elastic wall 52 and a stimulation base wall 54. The stimulation elastic wall 52 and a stimulation base wall 54 can be configured for relative movement between them. In an example the stimulation elastic wall 52 can be an elastomeric material, a rubber-like material, natural rubber, a silicone rubber, an ethylene propylene rubber, or a thermoplastic rubber. In an example, stimulation elastic wall 52 and the stimulation base wall 54 can be two separate pieces coupled together. In an example the stimulation base wall 54 can include a flat profile and be formed of a rigid material such as plastic. The thickness of the stimulation elastic wall 52 can be in the range of 0.2-30 mm.

In FIG. 1 the trigger chamber and the stimulation chamber are illustrated in two modes. In the first mode, trigger chamber 26A is expanded and the stimulation chamber 30A is retracted. In the second mode (dotted lines) trigger chamber 26B is compressed and the stimulation chamber 30B is expanded. The trigger chamber 26A can be compressed by pressure from a part of a body such as a portion of a foot, an ankle, a knee, or a back. When the trigger chamber 26A is compressed, the trigger elastic wall 36 is moved toward the trigger base wall 38 and the trigger chamber 26A enters the second mode of the trigger chamber 26B having a smaller volume. The smaller volume of trigger chamber 26B causes fluid to be forced through the connecting line 28A and into the stimulation chamber 30A. As fluid pushes into the stimulation chamber 30A, the stimulation elastic wall 52 moves away from the stimulation base wall 54 and the stimulation chamber 30A expands and enters the second mode illustrated as a stimulation chamber 30B (represented by dotted line). Stimulation chamber 30A is in a retracted state and stimulation chamber 30B is in an expanded state. Trigger chamber 26A is in an expanded state and trigger chamber 26B is in a compressed state.

The trigger elastic wall 36 can include a memory shape. When the trigger chamber 26A is not compressed, the memory shape can be biased to return to the expanded state of trigger chamber 26A. Returning to the expanded state can cause a vacuum effect that can allow fluid that has been pushed into the stimulation chamber 30B to return to the trigger chamber 26A.

In an example, the trigger elastic wall 36 and the trigger base wall 38 can be a single unit of the same material. In an example, the stimulation elastic wall 52 and the stimulation base wall 54 can be a single unit of the same material. In an example the trigger base wall 38 or the stimulation base wall 54 can be an elastomeric material, a rubber-like material, natural rubber, a silicone rubber, an ethylene propylene rubber, or a thermoplastic rubber. In an example, the connecting line 28A can have round or non-flattened cross section. In an example, the stimulation elastic wall 52 is thinner than the trigger elastic wall 36.

In an example, the trigger elastic wall 36 can include a first measure of elasticity. The first measure of elasticity can be a function of a thickness of the trigger elastic wall 36, or a quality of the material making up the trigger elastic wall 36 or a combination of both the type of material and the thickness. In an example, the stimulation elastic wall 52 can include a second measure of elasticity. The second measure of elasticity can be a function of a thickness of the stimulation elastic wall 52, or a quality of the material making up the stimulation elastic wall 52 or a combination of both the type of material and the thickness. In an example, the first measure of elasticity is different from the second measure of elasticity. In an example, the first and second measures of elasticity are equal. In an example, the first measure of elasticity is less than the second measure of elasticity. In an example, the first measure of elasticity is greater than the second measure of elasticity.

Figure 2:
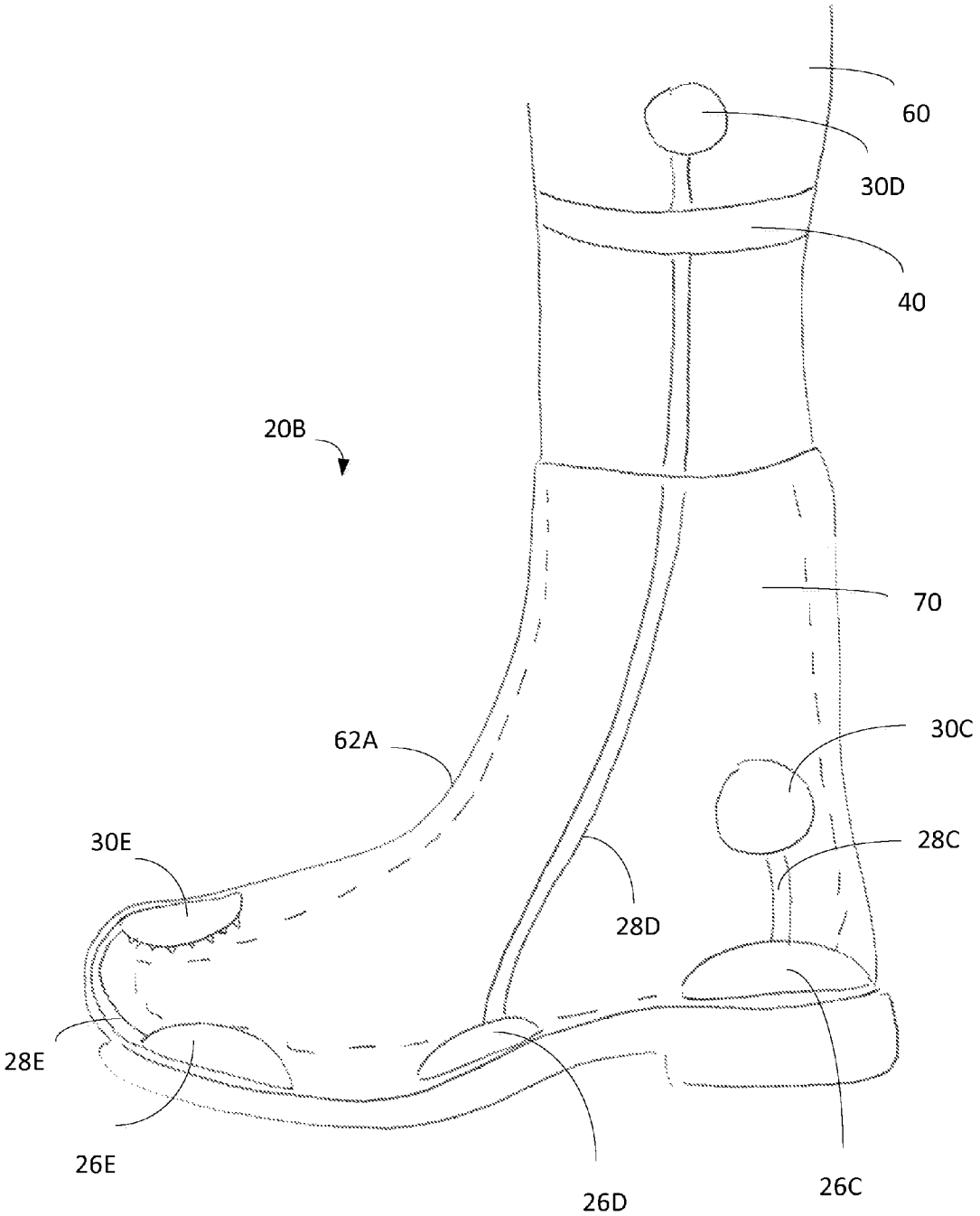
FIG. 2 illustrates a partial cross section of a device, in accordance with at least one example of the present subject matter.

FIG. 2 illustrates a partial cross section of a device 20B, in accordance with at least one example of the present subject matter. The device 20B can be located in an article of footwear 62A. The device 20B can be integral with the footwear 62A. The device 20B can include more than one trigger chamber, more than one connecting line and more than one stimulation chamber. Trigger chamber 26C can be located near the heel area of footwear 62A. The trigger chamber 26C can be fluidly coupled to a connecting line 28C that is fluidly coupled to a stimulation chamber 30C. The stimulation chamber 30C can be located near an ankle area of the footwear 62A. When pressure from the foot 70 is applied to trigger chamber 26C, portions of the stimulation chamber 30C will expand and exert pressure to stimulate the foot 70.

A trigger chamber 26D can be located near a side of the footwear 62A. The trigger chamber 26D can be fluidly coupled to a connecting line 28D that is fluidly coupled to a stimulation chamber 30D. The stimulation chamber 30D can be located on a portion of the leg 60. When pressure from the foot 70 is applied to trigger chamber 26D, portions of the stimulation chamber 30D will expand and contact the leg 70. The connecting line 28D and stimulation chamber 30D can be coupled to the leg 60 by a strap 40. Trigger chamber 26E can be located near the toe area of footwear 62A. The trigger chamber 26E can be fluidly coupled to a connecting line 28E that is fluidly coupled to a stimulation chamber 30E. The stimulation chamber 30E can be located near a toe area of the footwear 62A. When pressure from the foot 70 is applied to trigger chamber 26E, portions of the stimulation chamber 30E will expand and contact the foot 70.

The placements of trigger chambers and connections of device 20B illustrated in FIG. 2 are just one example of many possibilities. The trigger chambers can be positioned in any location that can receive pressure from the foot 70 during standing, movement, walking, running, or other activity where pressure can be applied to a portion of the foot 70. The connecting lines can be configured in any manner to allow pressure from a first location to cause stimulation at a different location. In an example, the trigger chamber 26C in the heel area can be connected to a stimulation chamber 30E in the toe area. Stimulation chambers can be placed at any location and can differ from the three locations illustrated. One trigger chamber can be connected to more than one stimulating chamber. In an example, trigger chamber 26C can be connected to stimulation chambers 30C, 30D, and 30E. In an example, trigger chamber 26D can be connected to stimulation chambers 30C, 30D, and 30E. In an example, trigger chamber 26E can be connected to stimulation chambers 30C, 30D, and 30E.

Placement and numbers of the trigger chambers can depend on what portion of a gait can benefit from stimulation. A gait that can require stimulation at the time the toe of the foot presses against the bottom of the footwear can include the trigger chamber 26E in the toe area of the footwear 62A. A gait that can require stimulation at the time of side movement of the foot in the footwear 62A, such as a swaying side to side, can include a trigger chamber 26D located in the side area. A gait that can require stimulation at the time of heel pressure can include a trigger chamber 26C located in the heel area. The stimulation can be provided at any phase of a gait, depending on the placement of the trigger chamber.

The article of footwear 62A can be configured as a boot as shown, or any other type of footwear such as a loafer, sandal, dress shoe, tennis shoe, high heeled shoe, or orthopedic shoe. The footwear can be configured to include portions that can reach far up a leg 60. In an example, device 20B can be removable from footwear 62A for use in another article of footwear.

Figure 3:
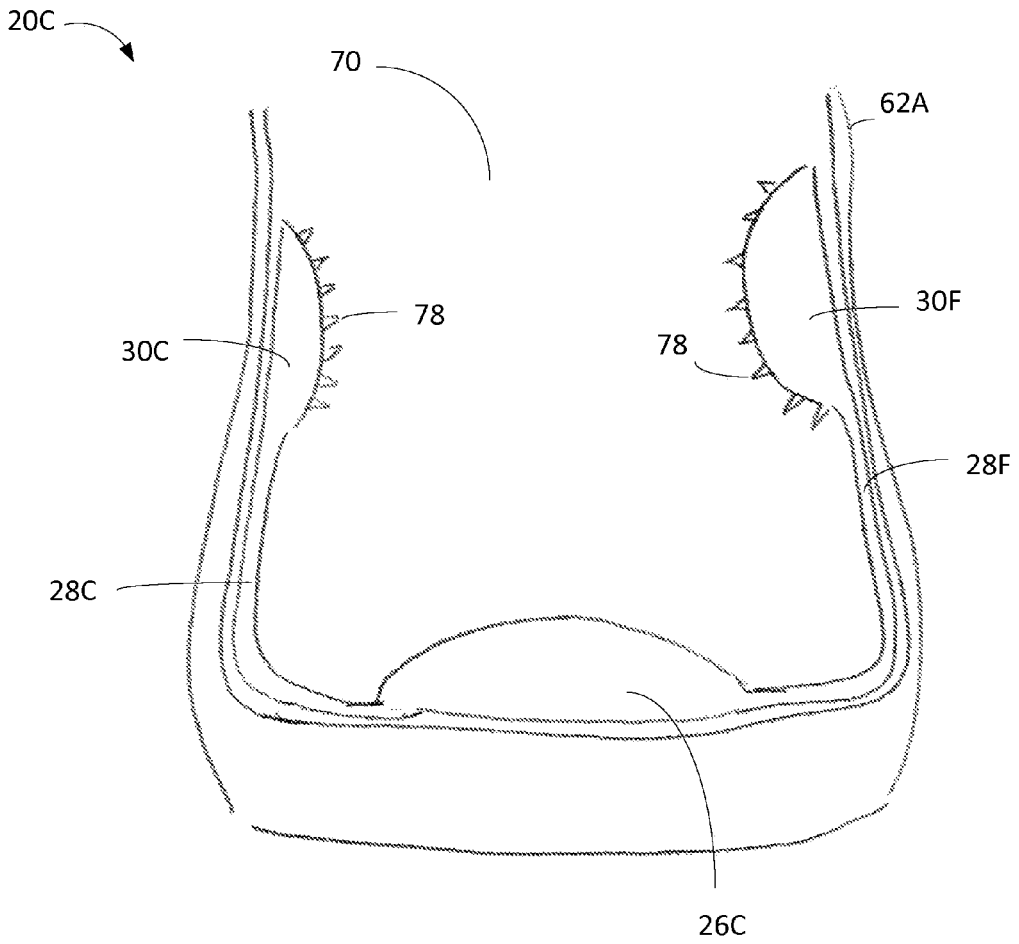
FIG. 3 illustrates cross section of a device, in accordance with at least one example of the present subject matter.

FIG. 3 illustrates cross section of a device 20C, in accordance with at least one example of the present subject matter. The trigger chamber 26C can be located in the heel area of the footwear 62A. A first connecting line 28C and a second connecting line 28F can be fluidly coupled to the trigger chamber 26C. The first and second connecting lines 28C, 28F can be routed up the left side and right side of the footwear 62A and fluidly coupled to a first stimulation chamber 30C and a second stimulation chamber 30F. The first and second stimulation chambers 30C, 30F can be located in the ankle area of the footwear 62A. The stimulation chambers 30C, 30F can include projections 78 coupled to an exterior surface of the stimulation chamber. The projections 78 can provide an enhanced stimulation to the foot 70. In an example, the trigger chamber can be fluidly connected to more than two stimulation chambers.

Figure 4:
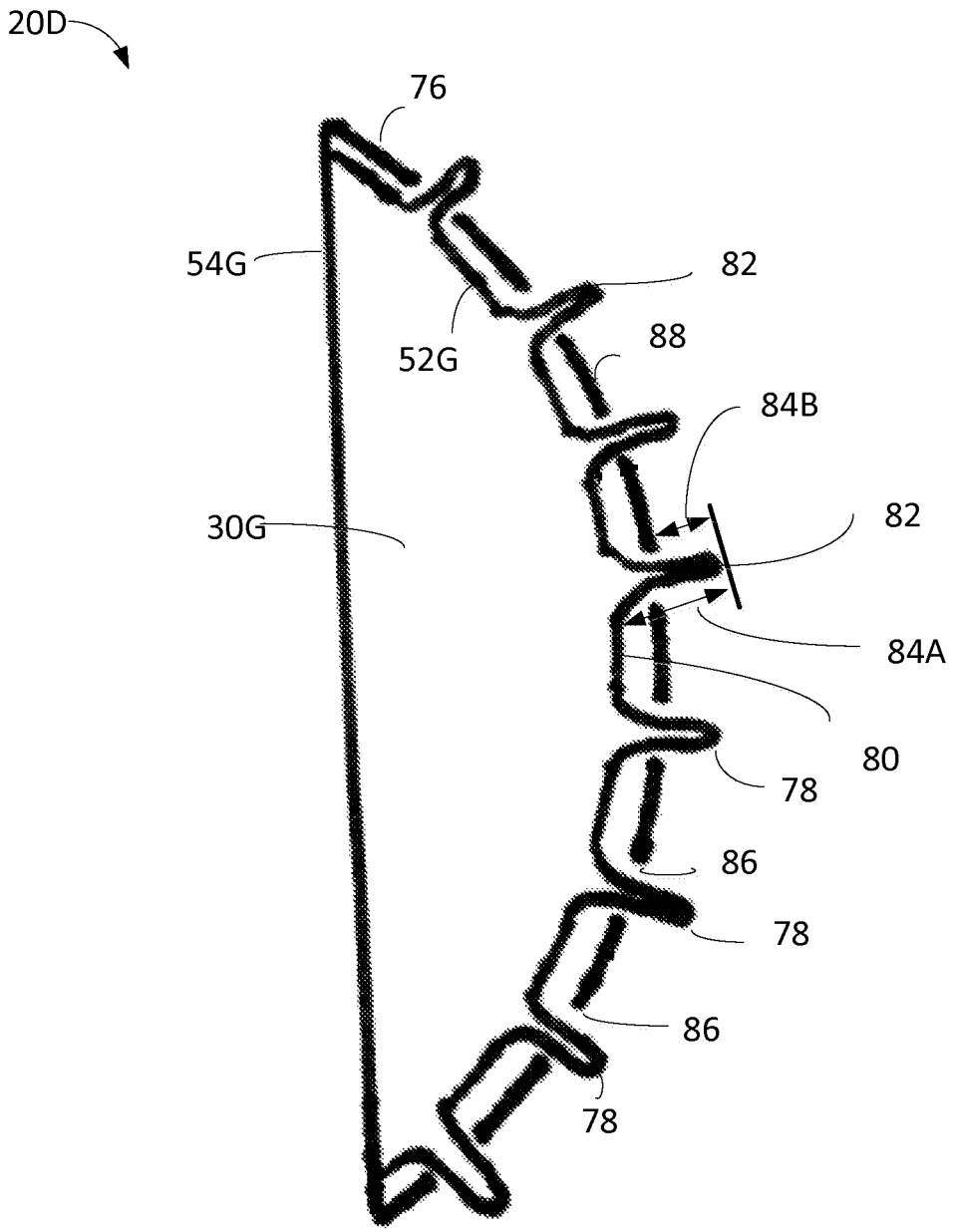
FIG. 4 illustrates a stimulation chamber in a stabilizing frame, in accordance with at least one example of the present subject matter.

FIG. 4 illustrates a stimulation chamber 30G covered by a stabilizing frame 76, in accordance with at least one example of the present subject matter. The rigid or semi-rigid stabilizing frame 76 can be included in a device 20D. The stabilizing frame 76 can cover the stimulation elastic wall 52G and can have a shape that conforms to the shape of an expanded stimulation chamber 30G. A plurality of projections 78 can be coupled to an exterior surface 80 of the stimulation elastic wall 52G. The projections 78 can include a narrowed tip 82. The projections 78 can contact the user or the user's clothing such as a stocking, when the stimulation elastic wall 52G has been expanded by fluid pushed from a trigger chamber. The projections 78 can include a rigid material. The projections 78 can be integral with the stimulation elastic wall 52G. Each projection 78 can extend outwardly from the exterior surface 80 to the tip 82 a distance 84A in the range of 2-15 mm.

When the stimulation chamber 30G expands, the projections 78 can extend outwardly through a plurality of apertures 86 located in the stabilizing frame 76. When the stimulation chamber is unpressurized and retracts, the projections 78 can retract back through the apertures 86. In an example, the projections 78 retract until no portion of the projections 78 extends outwardly past the surface of the stabilizing frame 76. This can serve to prevent stimulation and provide a smooth surface close to the user's skin. When the stimulation elastic wall 52G is expanded, the tips 82 of the projections 78 can extend past an outer surface 88 of the stabilizing frame 76 a distance 84B in the range of 2-15 mm. When the stimulation elastic wall 52G is in a retracted state, such as stimulation chamber 30A (see FIG. 1), the tips 82 of the projections 78 can extend past the outer surface 88 of the stabilizing frame 76 a distance in the range of 0-8 mm. The stabilizing frame 76 can be attached to a stimulation base wall 54G.

In an example, the tip 82 can be pointed, rounded, sharp, or dulled. In an example, the tip 82 can be a separate material from the stimulation elastic wall 52G and can be coupled to the exterior surface 80. In an example, the stabilizing frame 76 can be attached to a connecting line or other portion of the footwear.

Figure 5:
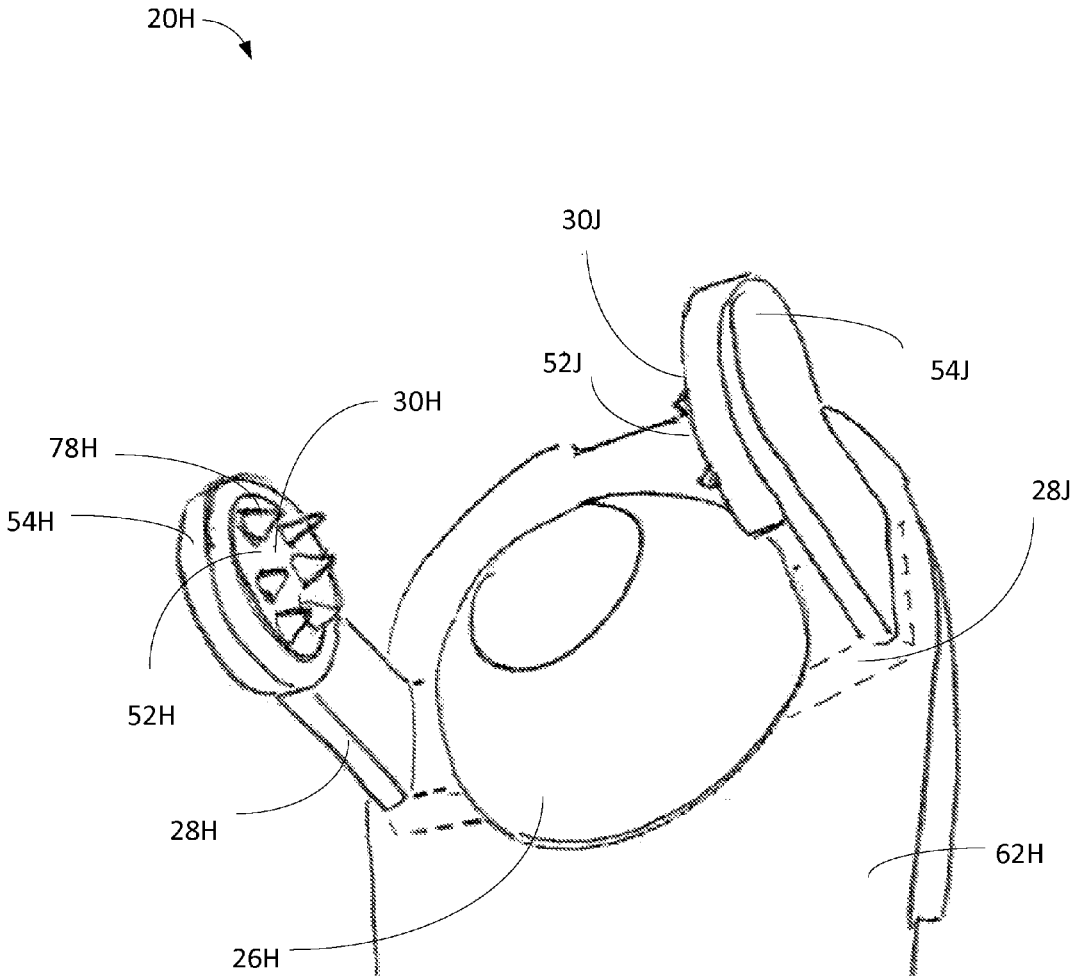
FIG. 5 illustrates an article of footwear having a device, in accordance with at least one example of the present subject matter.

FIG. 5 illustrates an article of footwear 62H having a device 20H, in accordance with at least one example of the present subject matter. The trigger chamber 26H can be located in the heel area as shown. Connecting lines 28H, 28J can be integral with the footwear 62H and can have a flattened rectangular profile. A fluid coupling between the trigger chamber 26H and portions of the connecting lines 28H, 28J can be located under the inner sole of the footwear 62H. Connecting lines 28H, 28J can be integral with the stimulation base walls 54H, 54J. The stimulation base walls 54H, 54J can surround the stimulation elastic walls 52H, 52J. The stimulation chambers 30H, 30J can be located in the ankle area of the footwear 62H. The stimulation chambers 30H, 30J and the trigger chamber 26H can include a circular profile as shown.

In use, the trigger chamber 26H can be compressed by a portion of a foot. Compression of the trigger chamber 26H causes fluid to be pushed through the inelastic connecting lines 28H, 28J and force the corresponding stimulation elastic wall 52H, 52J into an expanded state. The projections 78H are moved closer against skin or clothing of the user providing stimulation to improve a gait function.

In an example, other profiles for the trigger chamber 26H or stimulation chambers 30H, 30J can be rectangular, oval, having combinations of straight and curved portions, or irregularly shaped.

Figure 6:
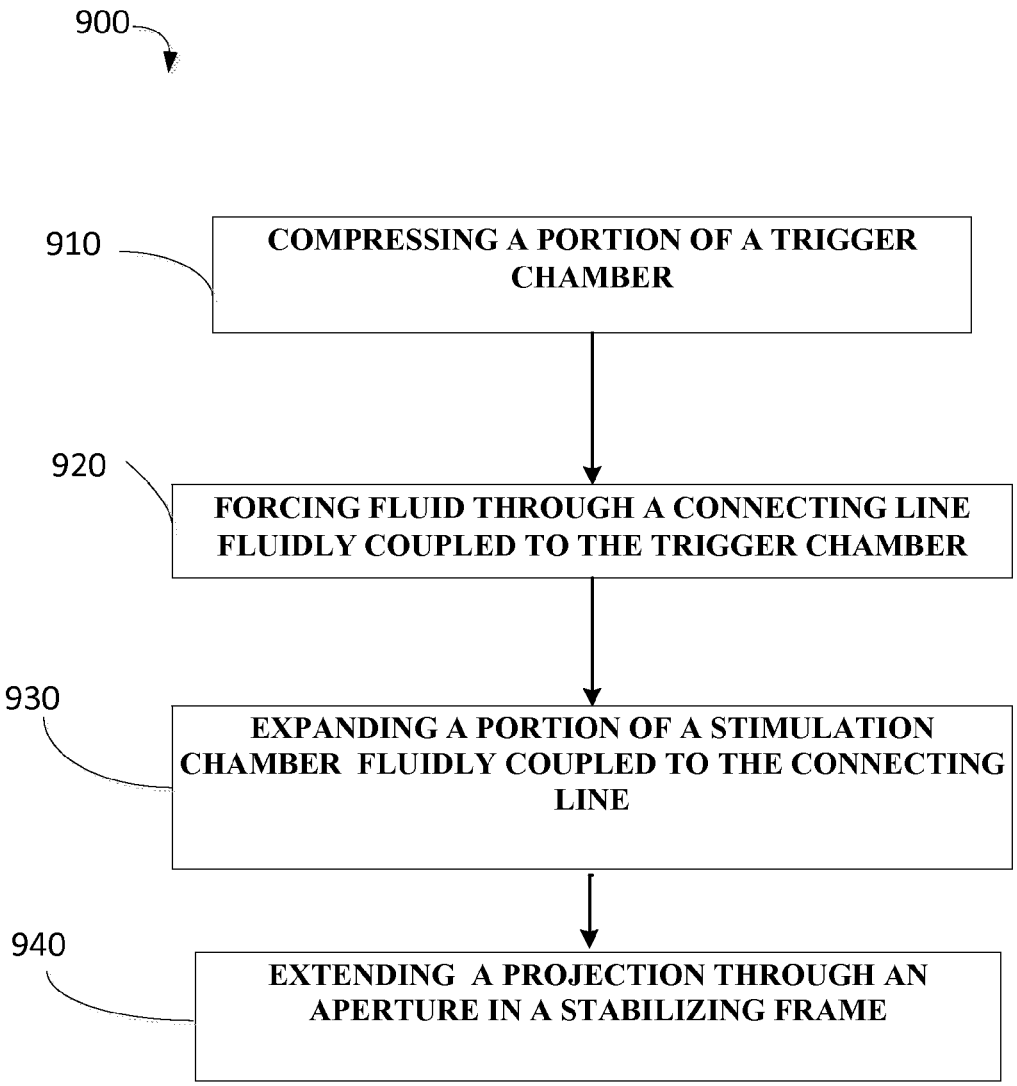
FIG. 6 illustrates a flow chart describing a method, in accordance with at least one example of the present subject matter.

FIG. 6 illustrates a flow chart describing a method, in accordance with at least one example of the present subject matter. Method 900 includes at 910, compressing a portion of a trigger chamber. The compression can be provided by pressure from a portion of the foot, such as the heel, the toe area, the ball, or the side of the foot. The pressure from the foot can occur while walking, running, standing, balancing, shuffling, swaying, or any movement of the foot. The pressure can occur during a normal or abnormal gait.

Method 900 includes at 920, forcing fluid through a connecting line fluidly coupled to the trigger chamber. The connecting line can be configured of substantially inelastic material. The connecting line can be routed to any exterior portion of a user's body.

Method 900, includes at 930, expanding a portion of a stimulation chamber fluidly coupled to the connecting line. When the trigger chamber is compressed, fluid is forced through the connecting line and into the stimulation chamber. The stimulation elastic wall expands and can contact a user.

Method 900, includes at 940, extending a projection through an aperture in a stabilizing frame. The stabilizing frame can provide a smooth surface that can rest against a user when the stimulation elastic wall is in a retracted state. Such a smooth surface can provide an unobtrusive device in the footwear when not activated by a trigger chamber. Then the stimulation elastic wall is activated into an expanded state, the projections, can extend through apertures in the stabilizing frame and perform the stimulation function. The stabilizing frame can be integral or attached to the connecting line and/or the stimulation base wall.

Method 900 can also include retracting the stimulation chamber, wherein a tip of each of the plurality of projections is configured to be located below the exterior surface of the stabilizing frame. As described above, the smooth surface of the stabilizing chamber can provide a non-stimulating surface against the skin or clothing of the user.

Method 900 can also include compressing of the trigger chamber and expanding the stimulating chamber are in phase with a gait. The fluid transfer from the trigger chamber, through the connecting line and into the stimulating chamber can be very fast. Stimulation is provided at virtually the same time as when the pressure is applied to the trigger chamber by the foot during a gait or some type of movement against a trigger chamber. In an example, a trigger chamber can be located in a position to receive pressure from another part of the body besides the foot, such as a hand, an elbow, a shoulder, a head, a back, or neck.

Method 900 can also include forcing fluid through a second connecting line and expanding a second stimulation chamber. More than one stimulation chamber can be fluidly connected to a trigger chamber. Placement of the multiple stimulation chambers can be varied and need not be symmetrical as shown in FIG. 4. The connection line length of multiple lines can be used to synchronize multiple stimulation chambers. In an example a trigger chamber having multiple connection lines can include one connection line that is shorter than the other to allow one stimulation chamber to activate slightly before the other.

Method 900 can also include forcing fluid through a third connecting line and expanding a third stimulation chamber. In an example, any number of connection lines, each connected to a stimulation chamber can be utilized in a device, limited only by the amount of fluid pressure delivered by the trigger chamber compression and the size of the stimulation chambers.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A device comprising:

a trigger chamber, having a trigger elastic wall and a trigger base wall, the trigger chamber configured for relative motion between the trigger elastic wall and the trigger base wall;

a connecting line fluidly coupled to the trigger chamber, the connecting line having a substantially inelastic wall;

a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface;

a plurality of projections coupled to the exterior surface; and a stabilizing frame, the stabilizing frame having a substantially rigid wall, the stabilizing frame having a plurality of apertures, the stabilizing frame extending over the stimulation chamber, the projections configured to extend through the apertures when the stimulation chamber is in an expanded state.

2. The device of claim 1, wherein when the stimulation chamber is in the expanded state, a tip of each projection extends outwardly from an outer surface of the stabilizing frame a distance in the range of 2-15 mm.

3. The device of claim 1, wherein when the stimulation chamber is in a retracted state, a tip of each projection extends outwardly from an outer surface of the stabilizing frame a distance in the range of 0-2 mm.

4. The device of claim 1, wherein a tip of each projection extends outwardly from the exterior surface a distance in the range of 2-20 mm.

5. The device of claim 1, wherein the stimulation elastic wall is configured of at least one of natural rubber, silicone rubber, ethylene propylene rubber, and thermoplastic rubber.

6. The device of claim 1, wherein the trigger elastic wall is configured of at least one of natural rubber, silicone rubber, ethylene propylene rubber, and thermoplastic rubber.

7. The device of claim 1, wherein the trigger elastic wall has a thickness in the range of 0.2-30 mm and the stimulation elastic wall has a thickness in the range of 0.2-30 mm and the stimulation elastic wall is thinner than the trigger elastic wall.

8. The device of claim 1, wherein the stimulation base wall and the trigger base wall have a flat profile and are configured of a rigid plastic material.

9. The device of claim 1, wherein the connecting line has a flattened cross-sectional profile having a height distance in the range of 6-16 mm.

10. The device of claim 1, further including a second connecting line fluidly coupled to the trigger chamber and the second connecting line fluidly coupled to a second stimulation chamber.

11. The device of claim 10, further including a third connecting line fluidly coupled to the trigger chamber and the third connecting line fluidly coupled to a third stimulation chamber.

12. The device of claim 1, wherein each of the plurality of projections is configured to be integral with the exterior surface, and each of the plurality of projections includes at least one of a narrowed tip and a rigid material.

13. The device of claim 1, wherein the device is configured to be removable from an article of footwear and usable in a different article of footwear.

14. The device of claim 1, wherein the trigger chamber, the connecting line, and the stimulation chamber are a closed fluid system.

15. A method comprising:

compressing a trigger chamber, the trigger chamber having a trigger elastic wall and a trigger base wall, the trigger chamber configured for relative motion between the trigger elastic wall and the trigger base wall;

forcing fluid through a connecting line, the connecting line fluidly coupled to the trigger chamber, the connecting line having a substantially inelastic wall;

expanding a stimulation chamber fluidly coupled to the connecting line, the stimulation chamber having a stimulation elastic wall and a stimulation base wall, the stimulation chamber configured for relative motion between the stimulation elastic wall and the stimulation base wall, the stimulation elastic wall having an exterior surface, wherein expanding the stimulation chamber causes a plurality of projections to contact a user, the plurality of projections coupled to the exterior surface; and extending a projection through an aperture in a stabilizing frame, the stabilizing frame covering the stimulation chamber, the stabilizing frame having a substantially rigid wall.

16. The method of claim 15, further comprising retracting the stimulation chamber, wherein a tip of each of the plurality of projections is configured to be located below the exterior surface of the stabilizing frame.

17. The method of claim 15, wherein the compressing of the trigger chamber and expanding the stimulating chamber are in phase with a gait.

18. The method of claim 15, further including forcing fluid through a second connecting line, the second connecting line fluidly coupled to the trigger chamber, the second connecting line having a substantially inelastic wall; and expanding a second stimulation chamber fluidly coupled to the second connecting line.

19. The method of claim 18, further including forcing fluid through a third connecting line, the third connecting line fluidly coupled to the trigger chamber, the third connecting line having a substantially inelastic wall; and expanding a third stimulation chamber fluidly coupled to the third connecting line.

* * * * *